United States Patent [19]

Moore et al.

[11] 4,090,944

[45] May 23, 1978

[54] PROCESS FOR CATALYTIC DEPOLYMERIZATION OF COAL TO LIQUID FUEL

[75] Inventors: Raymond H. Moore; John L. Cox, both of Richland, Wash.

[73] Assignee: Battelle Memorial Institute, Richland, Wash.

[21] Appl. No.: 720,582

[22] Filed: Sep. 7, 1976

[51] Int. Cl.[2] ..... C10G 1/06; C10G 1/08

[52] U.S. Cl. ..... 208/10; 208/9

[58] Field of Search ..... 208/8, 9, 10

[56] References Cited

U.S. PATENT DOCUMENTS

| | | | |
|---|---|---|---|
| 1,881,927 | 10/1932 | Pott et al. | 208/8 |
| 3,158,561 | 11/1964 | Neuworth et al. | 208/8 |
| 3,505,203 | 6/1967 | Nelson | 208/10 |
| 3,748,254 | 7/1973 | Gorin | 208/8 |
| 3,755,137 | 8/1973 | Schuman | 208/10 |
| 3,841,991 | 4/1973 | Cohen et al. | 208/8 |

OTHER PUBLICATIONS

Ouchi et al., *Fuel,* "Catalytic Depolymerization of Coals I–Depolymerization of Yubari Coal by p–Toluene Sulfonic Acid as Cat.", 44, (1), 29–38 (1965).

Ouchi et al., "Catalysts for the Depolymerization of Mature Coals"; Fuel; 52, Apr. 1973, pp. 156–157.

*Primary Examiner*—Delbert E. Gantz
*Assistant Examiner*—Joan Thierstein
*Attorney, Agent, or Firm*—Klarquist, Sparkman, Campbell, Leigh, Hall & Whinston

[57] ABSTRACT

A process for the depolymerization of coal which includes contacting coal with phenol and a Bronsted acid catalyst at elevated temperatures and pressures for a period of about 5 minutes. The liquid coal extract which results from this process can be subjected to hydrogenolysis to produce a liquid hydrocarbonaceous product oil.

12 Claims, 1 Drawing Figure

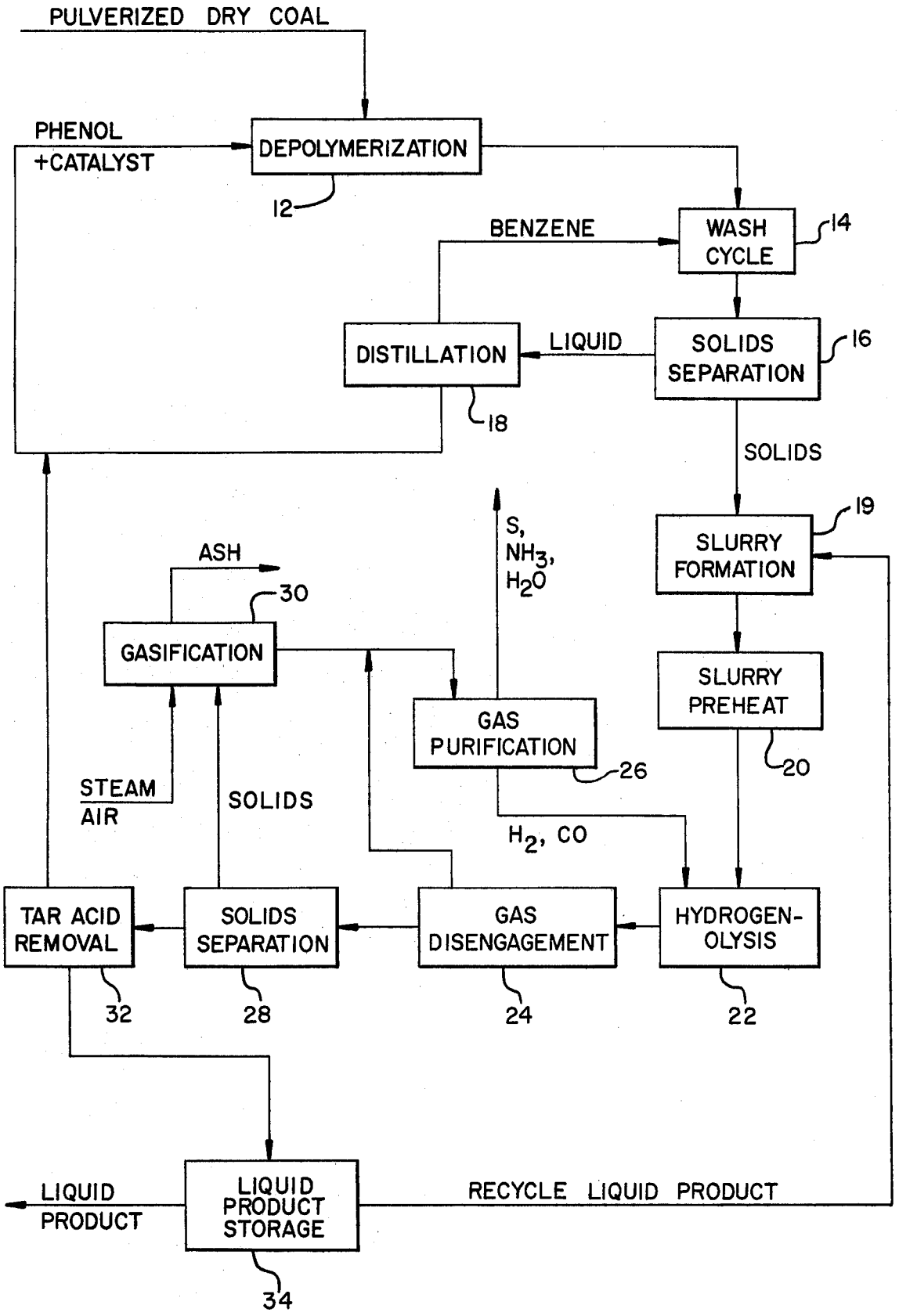
PULVERIZED DRY COAL
PHENOL
+CATALYST
DEPOLYMERIZATION
12
BENZENE
WASH CYCLE
14
DISTILLATION
LIQUID
SOLIDS SEPARATION
16
18
SOLIDS
S,
NH3,
H2O
SLURRY FORMATION
19
ASH
30
GASIFICATION
SLURRY PREHEAT
GAS PURIFICATION
26
20
STEAM
AIR
SOLIDS
H2, CO
TAR ACID REMOVAL
SOLIDS SEPARATION
GAS DISENGAGEMENT
HYDROGEN-OLYSIS
32
28
24
22
LIQUID PRODUCT
LIQUID PRODUCT STORAGE
RECYCLE LIQUID PRODUCT
34

PROCESS FOR CATALYTIC DEPOLYMERIZATION OF COAL TO LIQUID FUEL

BACKGROUND OF THE INVENTION

This invention relates to a process for the liquefaction of coal. More particularly, this invention relates to a process whereby coal is depolymerized to a coal extract by catalytic insertion of phenolic materials into the coal structure and to the hydrogenolysis of such a coal extract to produce a stable coal-derived oil.

Liquefaction of coal by depolymerization in an organic solvent has been known for many years. The liquefied coal extract which results from such a process is far more suitable for conversion into liquid fuel by hydrogenolysis than is untreated coal. A wide variety of organic solvents including phenol and related phenolic materials have been advanced as suitable organic solvents for the liquefaction of coal.

U.S. Pat. No. 1,881,927 which issued to Pott et al. in 1932 discloses an early attempt to depolymerize coal with phenol as a solvent and to hydrogenate the resulting liquid coal extract to produce hydrocarbon fuel. In order to achieve sufficient depolymerization with phenol, Pott conducts the depolymerization in several separate extraction steps at temperatures ranging between 320° and 400° C. This procedure requires a treatment time of a few hours. Although Pott discloses a desirable coal extract, the reaction conditions, especially the long holding times, make this and similar depolymerization processes impractical.

More recently, it was discovered that the addition of certain catalysts to the phenol solvent greatly improves the depolymerization of coal solids. The use of catalysts allow a reduction in severity of reaction conditions required to successfully depolymerize coal solids and in some cases permits shortened reaction times. U.S. Pat. No. 3,158,561 to Neuworth et al. discloses one such process in which $BF_3$ catalyzes depolymerization when it is complexed with the phenolic solvent. Use of the phenolic-$BF_3$ complex allows the depolymerization reaction to proceed at temperatures of 50° to 200° C. and at autogenous pressure for a period of only about 2 hours. This patent also describes a method of mechanically separating the coal extract from the phenol solvents which involves pouring the coal extract and excess solvents into benzene. When the extract and benzene are combined, all but a small fraction of coal extract precipitates in a granular form which can then be easily separated from the liquid by filtration or centrifugation. The liquid removed during this mechanical separation is vacuum fractionated to separate benzene and phenol from a pitch-like residue which is the benzene soluble fraction of the coal extract.

Despite reported increases in depolymerization efficiency, the $BF_3$ catalyst has several drawbacks which have prevented wide acceptance by commercial coal processors. $BF_3$ causes dealkylation of coal with production of alkylphenols, as by products, in fair yield. $BF_3$ also induces self-condensation of phenol to high molecular weight tars. Both of these side reactions cause undesirable consumption of phenol.

To avoid the difficulties introduced by the $BF_3$ catalyst, Ouchi et al. have experimented with $H_2SO_4$, p-toluene sulfonic acid ($CH_3C_6H_4SO_3H$), $C_6H_5SO_3H.H_2O$ and other Bronsted acids to catalyze the depolymerization of coal by phenol insertion. In an experimental system operating at phenol reflux temperatures and ambient pressures, Ouchi achieves depolymerization in periods from 1 to 50 hours. This work is reported in Fuel 44, 29(1965); 44, 205(1965); 46, 319(1967); 46 397(1967); 52, 156(1973).

The course of reaction whereby $BF_3$ catalyzes the insertion of phenol into the coal structure does not appear to be the same as Bronsted acid catalysts wherein the hydrogen ion is the actual active catalyst. The catalysts used by Ouchi are a significant improvement over the $BF_3$ catalyst. The process described by Ouchi, however, is not able to achieve sufficient reaction speed for large continuous flow operations and does not provide for the recovery of costly phenol consumed during the depolymerization reaction.

Darlage and Bailey (Fuel 55, 3(1976)) describe a variety of phenolic solvents which may be used for the depolymerization of coal.

SUMMARY OF THE INVENTION

An object of this invention is to provide a process whereby coal may be depolymerized by the insertion of phenol rapidly and under relatively mild conditions of temperature and pressure.

A further object of this invention is to provide a process whereby depolymerized coal extract may be subjected to hydrogenolysis to yield a liquid coal-derived oil of low molecular weight.

Still an additional object of this invention is to provide a system for the depolymerization and hydrogenolysis of coal in which the valuable catalysts and phenolic solvents may be continuously recycled thereby minimizing the operating costs of the system.

A further object of this invention is to provide an economical depolymerization process which enhances the reactivity of the coal to such an extent that the consumption of hydrogen during a subsequent hydrogenolysis is substantially lower than for typical coal hydrogenolysis processes.

A still further object of this invention is to provide suitable Bronsted acid catalysts for use in these processes.

Other objects will be apparent from the drawing and from the specification which follows.

In an embodiment, the present invention relates to a process for producing liquid hydrocarbonaceous products from solid carbonaceous materials which comprise the steps of depolymerizing the solid carbonaceous material, at liquefaction conditions, with a phenolic solvent in the presence of a Bronsted acid catalyst to produce a liquid extract, contacting the catalyst, excess phenolic material and extract with a stream of cool benzene thereby causing the extract to precipitate, mechanically isolating the extract, and hydrogenolyzing the extract to produce liquid hydrocarbon products.

It has been further discovered that $CF_3SO_3H$ and $CH_3SO_3H$ are superior Bronsted acids for depolymerizing hydrocarbonaceous material and that under operating conditions of 250°–350° C. and 100–200 psig, depolymerization is substantially complete after about 5 minutes.

BRIEF DESCRIPTION OF THE DRAWING

This invention is illustrated in the accompanying drawing which is a schematic flow diagram of a self-contained process for the catalytic depolymerization and hydrogenolysis of coal to liquid fuel including recycling of all solvents and catalysts.

DESCRIPTION OF THE PREFERRED EMBODIMENT

The solid hydrocarbonaceous material which may be depolymerized by the process of the present invention includes coal and similar naturally occurring hydrocarbonaceous materials. The present invention is particularly applicable to the conversion of a bituminous coal. Although the following process description refers only to the preferred bituminous coal, the discussion is equally applicable to other coals. The coal to be depolymerized may conveniently be pulverized to an average particle size of −20 Tyler mesh. Fine grinding is unnecessary because even massive coal particles can be broken up by the depolymerization step of this process.

The organic solvent used in the depolymerization step may be selected from the group of phenolic materials which includes phenol, cresylic acid, α-naphthol, m-xylenol, and mixtures of these phenolic compounds. It is convenient to use excess solvent since any surplus solvent is recovered and recycled.

The depolymerization conditions utilized in the present invention include a temperature of about 250° to 300° C. and a pressure of about 100 to 200 psig. Under these conditions and in the presence of a suitable catalyst, complete reaction of coal and phenol (89%, MAF basis) is accomplished very rapidly, e.g., in about 5 minutes. The rapid rate of coal depolymerization achieved by this process reduces the capacity requirements of the depolymerization unit which is essentially a heat exchanger through which a mixture of pulverized dry coal, phenol and catalyst are passed at elevated pressures. In addition, the rapid depolymerization rate is imperative to prevent repolymerization reactions which frequently occur during the slower depolymerization processes previously practiced.

In order to achieve these favorable depolymerization conditions, it is necessary to use an extremely active catalyst, preferably one which can be recycled with the phenolic solvent and which will avoid the difficulties encountered when $BF_3$ is used as a catalyst. Bronsted acid catalysts are found to be excellent for this purpose. $H_2SO_4$ and p-toluene sulfonic acid have previously proved to be suitable Bronsted acid catalysts. It has now been discovered that both trifluoromethane sulfonic acid and methane sulfonic acid catalyze the coal depolymerization reaction to an even greater extent than the previously used Bronsted acids. The effectiveness of various Bronsted acid catalysts was determined experimentally with high volatile bituminous coal. The results of this experimentation, showing the superiority of trifluoromethane sulfonic acid and methane sulfonic acid as catalysts, are summarized in Table I.

TABLE I

| Catalyst | % Coal Solubilized[a] | Concentration moles/kg coal |
|---|---|---|
| $CF_3SO_3H$ | 89 | 0.22 |
| $CH_3SO_3H$ | 79 | 0.22 |
| $H_2SO_4$ | 77 | 0.22 |
| $CH_3C_6H_4SO_3H$ | 74 | 0.22 |
| HF (48%) | <20 | 0.22 |

[a]% Coal soluble in phenol (25:1 phenol:coal ratio) after 1 hr. at 170° C at constant catalyst to coal ratio.

A major benefit of this rapid coal depolymerization process is that it may be combined with a hydrogenolysis step to form a rapid, continuous flow process for the production of liquid hydrocarbon products from solid hydrocarbonaceous material. The accompanying drawing illustrates a complete coal conversion process which includes both the rapid depolymerization step and the hydrogenolysis step. This combined process includes steps for recycling the various solvents and catalysts. Although this diagram illustrates the preferred embodiment of the present invention, it is to be understood that the improved depolymerization conditions and catalysts of the present invention could be incorporated in a variety of similar coal liquefaction processes without departing from the scope of the present invention.

Referring to the drawing, pulverized dry coal, a phenolic material such as phenol and an appropriate Bronsted acid catalyst such as trifluoromethane solfonic acid can be combined in a heat exchanger 12 where depolymerization of the coal takes place at a temperature of about 250° C. and a pressure of about 100 psi at a holding time of only about 5 minutes. The depolymerization product is essentially a liquid coal extract, but also includes a small amount of phenol-insoluble residues. The depolymerization product, catalyst and excess phenol are transported to a washer 14 where they are contacted with a stream of cooled benzene. The liquid coal extract, which is insoluble in benzene, forms a precipitate. The entire contents of the washer 14 are next passed through a centrifuge or other suitable mechanical separation means 16 where the precipitate and residue solids are separated from the liquid fraction which consists of benzene, excess phenol and catalyst. The liquid fraction from the separation means 16 is sent to a distillation unit 18 where the benzene is fractionally separated from the phenol and catalyst. The benzene is cooled and returned to the washer 14 for reuse in the precipitation reaction. The phenol and catalyst meanwhile are recirculated to the heat exchanger 12 for reuse in the depolymerization reaction.

Not all of the phenol initially sent to the heat exchanger 12 is recovered in the distillation unit 18. The phenol which was inserted into the coal structure during depolymerization remains a part of the precipitated coal extract. This amount of solvent may be recovered during a subsequent tar acid separation or refining of the oil which is the ultimate product of this process. Under some circumstances it may be necessary to add fresh phenolic material to the mixture in the heat exchanger 12 to make up for phenolic material which is converted into other hydrocarbons during the course of processing.

The solid fraction from the separation means 16 is transported to a mixer 19 where the solids are combined with a hydrocarbon oil to form a slurry. The slurry is preheated in a suitable heating means 20 and then passed to a hydrogenolysis unit 22. In this unit, substantially complete conversion of the slurried coal extract into liquid hydrocarbon products can be accomplished over a Co-Mo catalyst at 410° C. and 4300 psig $H_2$ pressure during a time period of a minute or less. Lower conversion rates have been observed under milder conditions. A great deal of literature describing hydrogenolysis procedures and catalysts is available. Many of the well known procedures and catalysts are suitable for this hydrogenolysis step.

Depolymerization of coal by the insertion of a phenolic solvent greatly increases the reactivity of coal with hydrogen. As a result, temperature, pressure and holding time are reduced to levels below those needed for hydrogenolysis of untreated coal. The results of laboratory experiments comparing the hydrogen reactivity of depolymerized coal with untreated coal appear in Table II. This table illustrates, for a variety of hydrogenolysis conditions, the improvement in reactivity which occurs when Ohio Bituminous Coal is depolymerized with phenol.

TABLE II

| Hydrogenolysis Condition | | | | | |
|---|---|---|---|---|---|
| Catalyst Type | Temp., ° C. | $H_2$ Pressure, psig | Time, hr | % Raw Coal Reacted | % Phenol Treated Coal Reacted |
| Co—Mo | 316–320 | 3200–3400 | 4 | 23 | 41 |
| Co—Mo | 281–292 | 2600–2780 | 4 | 0.9 | 21 |
| Ni—W | 404 | 1120–1190 | 4 | 60 | 74 |

In the hydrogenolysis unit 22 the previously prepared slurry is mixed with hydrogen gas at an elevated temperature and pressure. The consumption of hydrogen gas in this unit has a major economic impact on the practicality of the present system. In experimental procedures which compare the consumption of hydrogen for phenol depolymerized coal with consumption for untreated coal, it is found that conversion of coal into a liquid product required far less hydrogen gas when the coal had been pretreated with phenolic materials. Table II compares hydrogen consumption for the hydrogenolysis of treated and untreated coals. The phenol treated Ohio Bituminous Coal, hydrogenolyzed under more severe conditions for a longer period of time, produced a greater conversion to liquid coal products, but required only a fraction of the hydrogen gas consumed during hydrogenolysis of the untreated coal.

TABLE III

| Hydrogenolysis Condition | | | | | |
|---|---|---|---|---|---|
| Temp., ° C. | Time, hr | $H_2$ Pressure, psig | $H_2$ Consumed, scf/ton | Percent Converted | Sample Identity |
| 370 | 6 | 800 | 14,500 | 33 | Untreated coal |
| 420 | 36 | 800 | 6,400 | 47 | Phenol treated coal |

The contents of the hydrogenolysis unit 22 are moved to a gas disengager 24 in which the entrained gaseous products of the hydrogenolysis and any excess hydrogen gas are separated from the liquid and solid products. This gas is recycled to a gas purification system 26. The liquids and solids are moved from the gas disengager 24 to a solids separation means 28. This device may be a centrifuge or any equivalent means for separating suspended solids from liquids. The solids from the separation means 28 are combined with steam and air in a gasifier 30 where any reactive solids are converted into gases. Ash which remains after gasification is removed from the gasifier 30 and discharged from the process. Gases produced in the gasifier 30 are mixed with the gases recovered from the gas disengager 24 and sent to a gas purification system 26. In this system, hydrogen gas and carbon monoxide are separated from other gases such as sulfur compounds, ammonia and steam. The hydrogen gas and carbon monoxide are then recycled to the hydrogenolysis unit 22.

The liquid fraction from the separation means 28 is sent to a tar acid removal unit 32. In this unit tar acids are separated from the liquid fraction. The tar acid removal unit 32 preferably comprises a means for extracting the liquid fraction with a NaOH solution. The extractable tar acids are mostly phenolic compounds which may be admixed with the phenol-catalyst solution from the distillation unit 18. The combined solution which results can be used as a solvent in the depolymerization step. The other liquid products constitute a liquid hydrocarbon and are piped to product storage tanks 34. A portion of the product oil may be used in the mixer 19 to form the previously described slurry. Other portions of the product may be suitable for sale as petrochemicals or may be useful as feed stock for further refining processes.

While we have shown and described a preferred embodiment of our invention, it will be apparent to those skilled in the art that changes and modifications may be made without departing from our invention in its broader aspects.

We claim:

1. A process for converting solid, hydrocarbonaceous material into liquid hydrocarbon products which comprises:

reacting a solid, hydrocarbonaceous material with a phenolic material in the presence of a Bronsted acid catalyst selected from the group consisting of $CF_3SO_3H$ and $CH_3SO_3H$ at elevated temperature and pressure to at least partly depolymerize said solid, hydrocarbonaceous material to produce a liquid extract; and hydrogenolyzing said extract to produce liquid hydrocarbon products.

2. The process according to claim 1 wherein said solid, hydrocarbonaceous material is coal.

3. The process according to claim 1 which, prior to hydrogenolyzing, further comprises:

contacting the catalyst, excess phenolic material, and extract with a stream of cool benzene thereby causing the extract to precipitate; and mechanically separating the precipitated extract from the catalyst, excess phenolic material, and benzene.

4. The process according to claim 3 which further comprises:

fractionally distilling and recycling the separated catalyst, excess phenolic material and benzene.

5. The process according to claim 1 which further comprises:

disengaging gas entrained within said liquid hydrocarbon products;

separating any suspended solids from said liquid hydrocarbon products;

gasifying said solids; and purifying at least one of the gases selected from the group consisting of the disengaged gas and the gasified solids to provide hydrogen for use in said hydrogenolyzing.

6. The process according to claim 1 which further comprises:

removing tar acids from said liquid hydrocarbon products; and recycling said tar acids to comprise at least a portion of said phenolic material.

7. The process according to claim 1 wherein said phenolic material is selected from the group consisting of phenol, cresylic acid, naphthol, m-xylenol, and mixtures thereof.

8. The process according to claim 1 wherein said elevated temperature is about 250°-300° C., said elevated pressure is about 100 to 200 psig; and said reacting is accomplished in about 5 minutes or less.

9. A process for the depolymerization of solid, hydrocarbonaceous material comprising:

reacting a solid, hydrocarbonaceous material with a phenolic material in the presence of a Bronsted acid catalyst selected from the group consisting of $CF_3SO_3H$ and $CH_3SO_3H$ at 250°-300° C. and 100-200 psig.

10. The process according to claim 9 which further comprises:

contacting the catalyst, excess phenolic material, and extract with a stream of cool benzene thereby causing the extract to precipitate;

mechanically separating the precipitated extract from the catalyst, excess phenolic material, and benzene;

fractionally distilling and recycling the separated catalyst, excess phenolic material and benzene;

hydrogenolyzing said extract to produce liquid hydrocarbon products;

disengaging gas entrained within said liquid hydrocarbon products;

separating any suspended solids from said liquid hydrocarbon products;

gasifying said solids;

purifying at least one of the gases selected from the group consisting of the disengaged gas and the gasified solids to provide hydrogen for use in said hydrogenolyzing;

removing tar acids from said liquid hydrocarbon products; and recycling said tar acids to comprise at least a portion of said phenolic material.

11. The process according to claim 9 wherein said phenolic material is selected from the group consisting of phenol, cresylic acid, naphthol, m-xylenol, and mixtures thereof.

12. A process for the depolymerization of solid hydrocarbonaceous material comprising:

reacting a solid, hydrocarbonaceous material with a phenolic material in the presence of a Bronsted acid catalyst selected from the group consisting of $CF_3SO_3H$ and $CH_3SO_3H$ at elevated temperature and pressure to at least partially depolymerize said solid, hydrocarbonaceous material to produce a liquid extract.

* * * * *